United States Patent [19]

Nakajima

[11] Patent Number: 4,778,352

[45] Date of Patent: Oct. 18, 1988

[54] VARIABLE CAPACITY VANE COMPRESSOR

[75] Inventor: Nobuyuki Nakajima, Saitama, Japan

[73] Assignee: Diesel Kiki Co., Ltd., Tokyo, Japan

[21] Appl. No.: 884,756

[22] Filed: Jul. 11, 1986

[30] Foreign Application Priority Data

Jul. 19, 1985 [JP] Japan ..... 60-160760

[51] Int. Cl.[4] ..... F04B 49/00; F04B 49/02

[52] U.S. Cl. ..... 417/295; 417/310

[58] Field of Search ..... 418/15, 159; 417/310, 417/295

[56] References Cited

U.S. PATENT DOCUMENTS

| | | | |
|---|---|---|---|
| 3,381,891 | 5/1968 | Bellmer | 418/159 |
| 3,451,614 | 6/1969 | Tosh | 418/13 |
| 3,723,024 | 3/1973 | Sawai | 418/159 |
| 4,137,018 | 1/1979 | Bruchen | 418/16 |
| 4,272,227 | 6/1981 | Woodruff | 417/440 |
| 4,395,203 | 7/1983 | Takada | 417/282 |
| 4,502,850 | 3/1985 | Fwagaki | 417/440 |
| 4,557,670 | 12/1985 | Fwagaki | 417/299 |
| 4,621,986 | 11/1986 | Sudo | 417/316 |
| 4,726,740 | 2/1988 | Suzuki | 417/292 |

FOREIGN PATENT DOCUMENTS

| | | | |
|---|---|---|---|
| 174516 | 3/1986 | European Pat. Off. | 418/78 |
| 137813 | 7/1982 | Japan | 417/270 |
| 59-28077 | 2/1984 | Japan . | |

*Primary Examiner*—William L. Freeh

*Attorney, Agent, or Firm*—Frishauf, Holtz, Goodman & Woodward

[57] ABSTRACT

An improved variable capacity vane compressor has at least one second inlet port formed in a cylinder for communicating a suction chamber with at least one compression chamber during a suction stroke. An opening control device varies the opening angle of the second inlet port, and has a pressure receiving portion defining a first pressure chamber communicating with a high pressure side, and a second pressure chamber communicating with a low pressure side. The control device is angularly displaceable in response to a difference between a high pressure and a low pressure in the chambers for causing the opening angle of the second inlet port to vary. A pressure control device is responsive to at least one parameter representative of a thermal load on the compressor for varying at least one of the high and low pressures in the first and second pressure chambers.

10 Claims, 9 Drawing Sheets

VARIABLE CAPACITY VANE COMPRESSOR

BACKGROUND OF THE INVENTION

This invention relates to variable capacity vane compressors which are adapted for use as refrigerant compressors in air conditioners for automotive vehicles.

A variable capacity vane compressor is known e.g. by Japanese Provisional Utility Model Publication No. 55-2000 filed by the same assignee of the present application, which is capable of controlling the capacity of the compressor by varying the suction quantity of a gas to be compressed. According to this known vane compressor, an arcuate slot is formed in a peripheral wall of the cylinder and extends from a lateral side of a refrigerant inlet port formed through the same peripheral wall of the cylinder and also through an end plate of the cylinder, and in which is slidably fitted a throttle plate, wherein the effective circumferential length of the opening of the refrigerant inlet port is varied by displacing the throttle plate relative to the slot so that the compression commencing position in a compression chamber defined in the cylinder varies to thereby vary the capacity or delivery quantity of the compressor. A link member is coupled at one end to the throttle plate via a support shaft secured to the end plate, and at the other end to an actuator so that the link member is pivotally displaced by the actuator to displace the throttle plate.

However, according to the conventional vane compressor, because of the intervention of the link member between driving means or the actuator and a control member or the throttle plate for causing displacement of the throttle plate, the throttle plate undergoes a large hysteresis, leading to low reliability in controlling the compressor capacity, and also the capacity control mechanism using the link member, etc. requires complicated machining and assemblage.

Further, a variable capacity vane compressor which has a reduced hysteresis of the control member has been proposed by Japanese Patent Application No. 60-71984 filed by the same assignee of the present application, which provides an improvement in a vane compressor comprising a cylinder formed of a cam ring and a pair of side blocks closing opposite ends of the cam ring, a rotor rotatably received within the cylinder, a plurality of vanes radially slidably fitted in respective slits formed in the rotor, a control member disposed for displacement in a refrigerant inlet port formed in one of the side blocks, and driving means for causing the control member to be displaced relative to the refrigerant inlet port, whereby the capacity or delivery quantity of the compressor can be varied by displacement of the control member. The improvement comprises driven teeth provided on the control member, and driving teeth provided on an output shaft of the driving means in mating engagement with the driven teeth, whereby the control member is driven directly by the driving means through the mating driving and driven teeth.

However, according to this proposed vane compressor, a stepping motor as the driving means is mounted within the compressor housing, requiring a large space for accommodation of the stepping motor, and the capacity control mechanism has an overall complicated construction and accordingly is high in manufacturing cost.

SUMMARY OF THE INVENTION

It is an object of the invention to provide a variable capacity vane compressor which has a capacity control mechanism which is simple in structure and compact in size, thus facilitating assemblage and requiring a low manufacturing cost, but is capable of controlling the compressor capacity with high reliability.

It is a further object of the invention to provide a variable capacity vane compressor in which the vanes have their tips sliding on the inner peripheral wall of the cylinder with reduced contact pressure when the compressor is in a reduced capacity operating mode.

According to the invention, there is provided a variable capacity vane compressor including a housing defining therein a suction chamber, a cylinder arranged within the housing and formed of a cam ring and a pair of side blocks closing opposite ends of the cam ring, one of the side blocks having at least one first inlet port formed therein, a rotor rotatably received within the cylinder, and a plurality of vanes radially slidably fitted in respective slits formed in the rotor, wherein compression chambers are defined between the cylinder, the rotor and adjacent ones of the vanes and varies in volume with rotation of the rotor for effecting suction of a compression medium from the suction chamber into the compression chambers through the at least one first inlet port, compression and discharge of the compression medium.

The variable capacity vane compressor according to the invention is characterized by the improvement comprising: at least one second inlet port, adjacent a corresponding first inlet port, formed in the one of the side blocks and communicating the suction chamber with at least one of the compression chambers which is on a suction stroke; opening control means for varying the opening angle of the at least one second inlet port, the opening control means having a pressure receiving portion defining a first pressure chamber supplied with a high pressure and a second pressure chamber supplied with a low pressure, the pressure receiving portion being angularly displaceable in response to a difference between the high pressure in the first pressure chamber and the low pressure in the second pressure chamber for causing the opening control means to vary the opening angle of the at least one second inlet port (which defines compression timing); and pressure control means responsive to at least one parameter representative of a thermal load on the compressor for varying at least one of the high pressure in the first pressure chamber and the low pressure in the second pressure chamber, whereby a change in the opening angle of the at least one second inlet port causes a change in the timing of initiation of the compression of the compression medium.

The above and other objects, features and advantages of the invention will be more apparent from the ensuing detailed description taken in conjunction with the accompanying drawings.

DETAILED DESCRIPTION

The invention will now be described in detail with reference to the drawings showing embodiments thereof.

Figure 1:
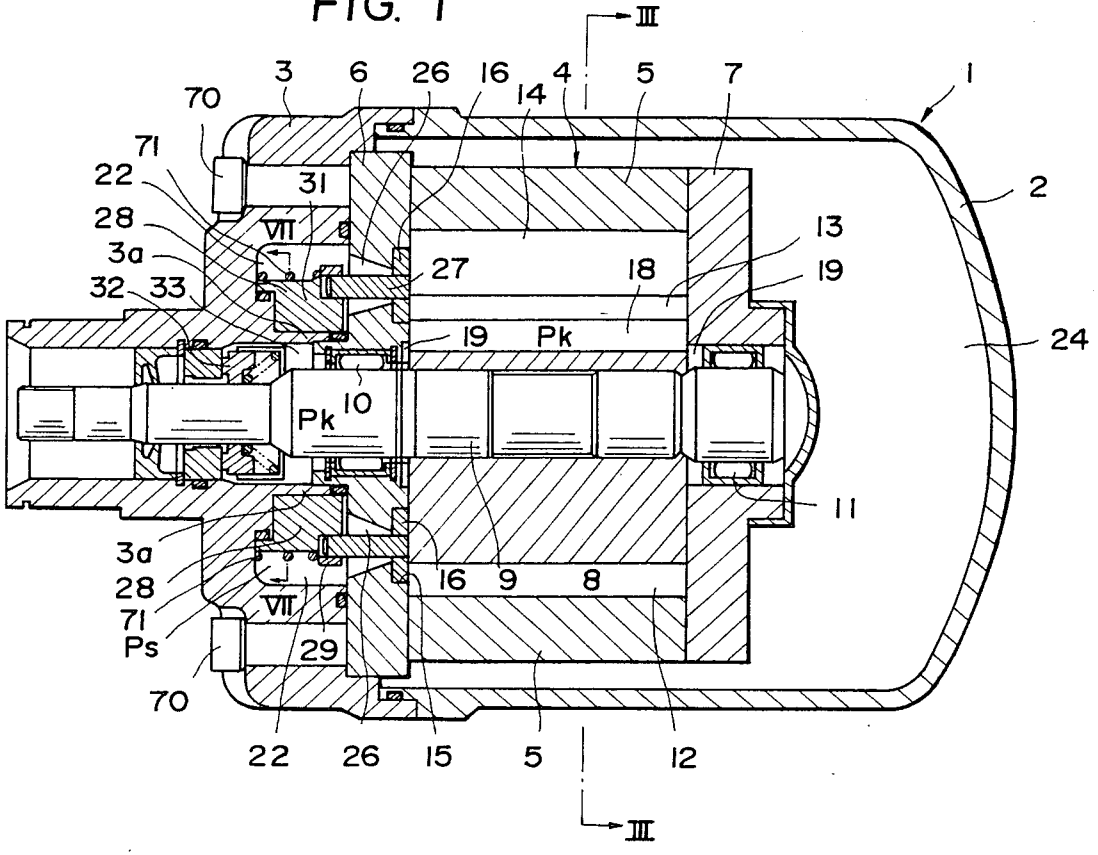
FIG. 1 is a longitudinal sectional view of a variable capacity vane compressor at maximum capacity operation according to a first embodiment of the invention.

FIG. 1 shows a variable capacity vane compressor according to a first embodiment of the invention, wherein a housing 1 comprises a cylindrical casing 2 with an open end, and a front head 3, which is fastened to on the casing 2 by means of bolts 70 in a manner closing the opening of the casing 2.

A pump body 4 is housed in the housing 1. The pump body 4 is composed mainly of a cylinder formed by a cam ring 5, and a front side block 6 and a rear side block 7 closing open opposite ends of the cam ring 5, a rotor 8 rotatably received within the cam ring 5, and a drive shaft 9 of the rotor 8. The drive shaft 9 is supported by a pair of radial bearings 10 and 11 provided in the side blocks 6 and 7, respectively.

Figure 3:
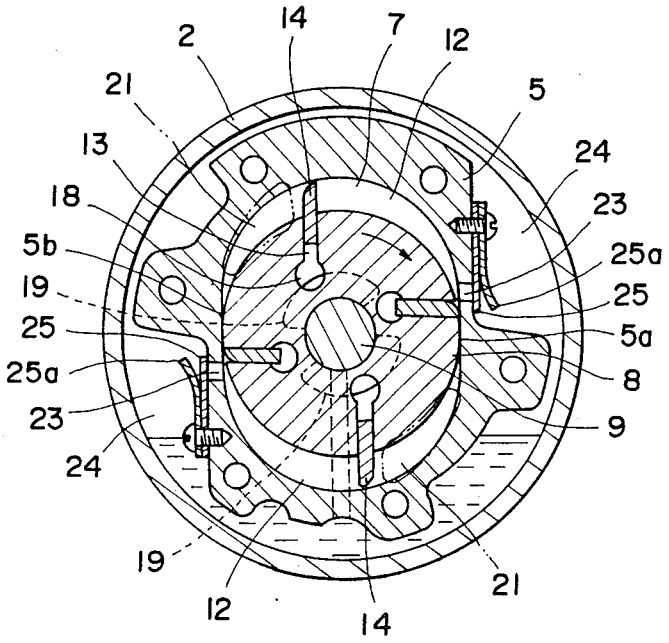
FIG. 3 is a transverse sectional view taken along line III—III in FIG. 1.

The cam ring 5 has an elliptical cross section, as shown in FIG. 3. The rotor 8 has its outer peripheral surface in sliding contact with diametrically opposite contacting portions 5*a* and 5*b* of the cam ring 5, wherein four compression chambers 12, 12 are defined between the inner peripheral surface of the cam ring 5 and the outer peripheral surface of the cylindrical rotor.

The rotor 8 has its outer peripheral surface formed with a plurality of (four in the illustrated embodiment) axial vane slits 13 at circumferentially equal intervals, in each of which a vane 14 is radially slidably fitted. The compression chambers 12, which are partitioned by respective adjacent pairs of the vanes 14, vary in volume as the rotor 8 rotates. Formed at the bottom of each vane slit 13 is a back pressure chamber 18.

A pair of back pressure communication grooves 19 are provided in an end face of each of the front side block 6 and the rear side block 7 which is in sliding contact with the rotor 8, in a diametrically symmetrical fashion.

Since the back pressure communication grooves 19 of the side blocks 6 and 7 are of the same shape, only that of the front side block 6 will be described, while the rear side block 7 has its couterparts in the front side block 6 designated by identical numerals. The back pressure communication grooves 19 in the front side block 6 extend along an edge of the bearing 10 of the shaft 9, and are so located as to communicate with the back pressure chambers 18. Refrigerant inlet ports 21 and 21 are formed in the front side block 6 at diametrically opposite locations radially outward of the back pressure communication grooves 19, 19. An annular suction chamber 22 is defined in the front head 3 and by the front side block 6 and disposed to communicate with each compression chamber 12 on the suction stroke via these refrigerant inlet ports 21. Refrigerant outlets 23, 23 are formed through the peripheral wall of the cam ring 5 at diametrically opposite locations. A discharge pressure chamber 24 is defined in the casing 2 and disposed to communicate with each compression chamber 12 on the compression stroke via these refrigerant outlet ports 23. Each outlet port 23 is provided with a dischage valve 25 and a discharge valve stopper 25*a*. Incidentally, the discharge pressure chamber 24 communicates with a refrigerating circuit, not shown, through a discharge port, not shown, formed through the wall of the casing 2.

Figure 4:
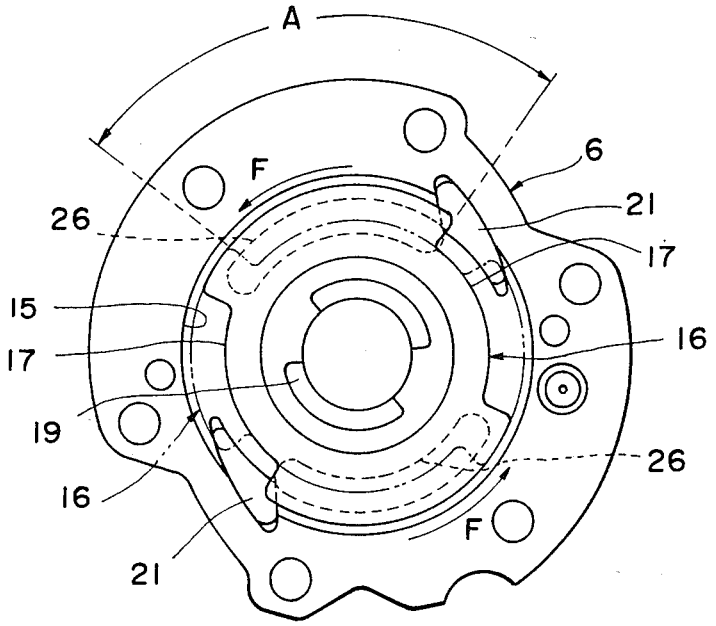
FIG. 4 is an end view of a front side block provided with a control element.
Figure 5:
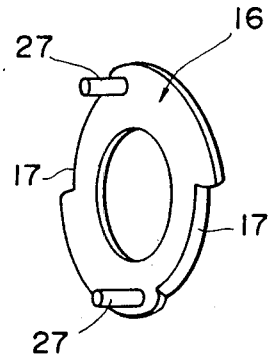
FIG. 5 is a perspective view of the control element.

An annular groove 15 is formed in the rear end face of the front side block 6, as shown in FIGS. 1 and 4. A pair of second inlet ports 26, 26 are formed, at diametrically opposite locations, through the front side block 6, extending from the bottom of the annular groove 15 to the front end face of the front side block 6. An annular control element 16, as shown in FIG. 5, is received in the groove 15 for rotation to control the opening angle of the second inlet ports 26, 26. The control element 16 is disposed in sliding contact with or in close proximity to the front end face of the rotor 8 so that the element 16 receives a frictional turning force F from the rotor 8, as hereinafter described. The control element 16 has a pair of diametrically opposite cut-out portions 17, 17, and a pair of axially extending pins 27, 27 fixed at upper and lower peripheral portions thereof, as viewed in FIG. 1.

Figure 6:
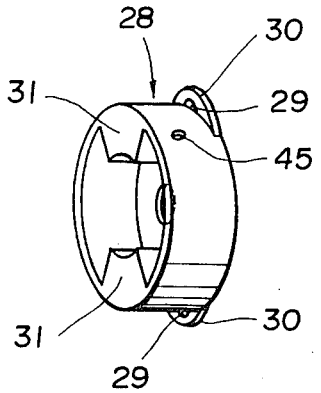
FIG. 6 is a perspective view of a rotary element.
Figure 7:
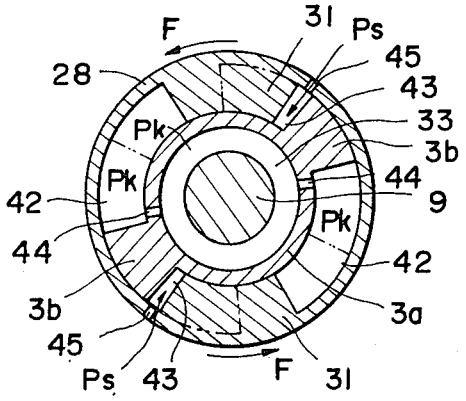
FIG. 7 is a transverse sectional view taken along line VII—VII in FIG. 1.

A boss 3*a* in the front head 3 has a pair of diametrically opposite protuberances 3*b* radially extending integrally from the outer periphery of the boss 3*a*, as shown in FIG. 7. A cylindrical rotary element 28, as shown in FIG. 6, is fitted on the boss 3*a* for rotation thereabout, at an opposite side of the front side block 6 to the control element, and is rotationaly urged by a torsion spring 71.

The rotary element 28 has a pair of flanges 30, 30 on its outer periphery, each of which has a hole 29 to receive therethrough a corresponding pin 27 of the control element 16. Thus, the rotary element 28 and the control element 16 rotate as one body. As shown in FIG. 1, the pins 27, 27 penetrate the respective second inlet ports 26, 26. A pair of diametrically opposite pressure-receiving protuberances 31, 31 are provided on the inner periphery of the rotary element 28. The pressure-receiving protuberances 31 have their opposed inner peripheral surfaces disposed in sliding contact with the outer peripheral surface of the boss 3*a* of the front head 3, and the protuberances 3*b* of the boss 3*a* have their outer peripheral surfaces disposed in sliding contact with the inner peripheral surface of the rotary element 28. Two pairs of volume-variable high pressure chambers 42, 42 and low pressure chambers 43, 43, each pair being located at diametrically opposite locations, are defined between the protuberances 3*b* and the pressure-receiving protuberances 31, 31 (FIG. 7).

An internal space 33 is provided in the boss 3*a* of the front head 3 at a location between the bearing 10 on the front side and a sealing assembly 32, and communicates with the high pressure chambers 42, 42 via communication holes 44, 44 formed through the peripheral wall of the boss 3*a*. The internal space 33 also communicates with the back pressure chambers 18 via the bearing 10 on the front side and the back pressure communication grooves 19 so that a back pressure Pk is introduced into the high pressure chambers 42.

On the other hand, the low pressure chambers 43, 43 communicate with the suction chamber 22 via communication holes 45, 45 formed through the peripheral wall of the rotary element 28 so that a suction pressure Ps is introduced into the low pressure chambers 43.

Figure 8:
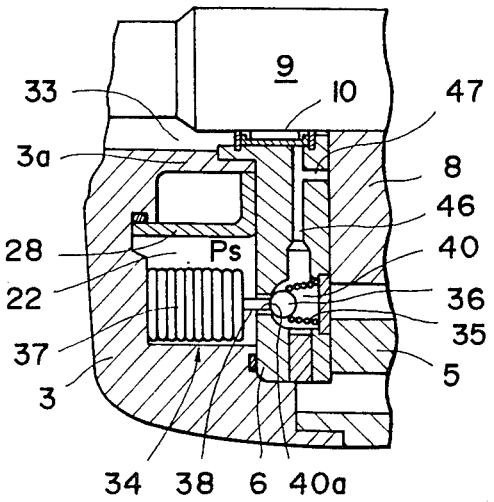
FIG. 8 is a longitudinal sectional view showing a valve mechanism.

FIG. 8 shows a valve mechanism 34 located in the suction chamber 22 and the front side block 6. A valve chamber 40 is formed in the front side block 6, in which is arranged a ball valve 36, urged by a coil spring 35 in such a direction as to close a communication port 40*a* formed in the side block 6 and communicating between the valve chamber 40 and the suction chamber 22. The ball valve 36 is abutted by an end of a push rod 38 integral with a flexible bellows 37 mounted in the suction chamber 22. The valve chamber 40 communicates with the bearing 10 on the front side via a passage 46 formed in the side block 6, and with the front end face of the rotor 8 via the passage 46 and a passage 47 branching off from the passage 46. When the suction pressure Ps in the suction chamber 22 is higher than a predetermined value (e.g. 2 kg/cm$^2$), the bellows 37 contracts against its own expanding force, as shown in FIG. 8, whereby the ball valve 36 blocks the communication port 40*a*. On the other hand, when the suction pressure Ps becomes lower than the predetermined value, the bellows 37 expands so that the push rod 38 urgingly displaces the ball valve 36 against the force of the spring 35 to thereby open the communication port 40*a*.

The operation of the vane compressor constructed as above will now be described.

When the drive shaft 9 is driven by an engine of the vehicle or the like, the rotor 8 is rotated in the clockwise direction as viewed in FIG. 3, whereby the vanes 14 receive a centrifugal force produced by rotation of the rotor and the back pressure from the back pressure chambers 18 so that the vanes 14 are moved radially outward of the vane slits 13, with their tips slidingly urged against the inner peripheral surface of the cam ring 5. During the suction stroke where the volume of each compression chamber 12 is increased, refrigerant is sucked into the compression chamber 12 via a suction port, not shown, provided in the front head 3, the suction chamber 22, and the corresponding refrigerant inlet port 21, and during the compression stroke where the volume of the compression chamber 12 is decreased, the refrigerant is compressed. Then, during a discharge stroke which occurs at the end of the compression stroke, the compressed refrigerant is discharged into the discharge pressure chamber 24 through the refrigerant outlet ports 23 and discharge valves 25 and then supplied to the refrigerating circuit of the air conditioner.

While the compressor is operating, the control element 16 is always acted upon by a turning force F produced by the rotating rotor 8 to turn in the same direction as the rotor 8 (i.e. counterclockwise, as viewed in FIG. 4, or in the direction to increase the opening angle of the second inlet ports 26), because of the fact that the clearance between the control element 16 and the end face of the rotor 8 is very small, and due to the viscosity of refrigerant gas filled in the clearance.

When the compressor is operating in a low speed region where the suction pressure Ps in the suction chamber 22 is higher than the aforementioned predetermined value, the bellows 37 of the valve mechanism 34 contracts to cause the ball valve 36 to block the communication port 40*a* via the push rod 38, whereby the communication between the high pressure chamber 42 and the suction chamber 22 is interrupted. As a result, the back pressure Pk in the high pressure chamber 42 is held high such that the difference between the back pressure Pk and the suction pressure Ps, i.e. Pk-Ps, is greater than the turning force F, whereby the rotary element 28 together with the control element 16 is rotated against the turning force F, in such a direction that the volume of the high pressure chamber 42, to which the back pressure Pk is supplied, increases (i.e. clockwise as viewed in FIGS. 4 and 7), until the elements 28 and 16 assume positions indicated by the solid lines in FIGS. 4 and 7 to thereby close the suction ports 26 of the front side block 6. In this case, during the suction stroke all the refrigerant that is sucked into the compression chamber 12 from the suction chamber 22 via the corresponding refrigerant inlet port 21 is compressed during the following compression stroke and then discharged. Thus, the amount of refrigerant that is compressed and discharged is the maximum, so that the compressor is operated at its maximum capacity.

On the other hand, when the compressor is operating in a high speed region where the suction pressure Ps in the suction chamber 22 is smaller than the predetermined value, the bellows 37 of the valve mechanism 34 expands to urgingly displace the ball valve 36 via the push rod 38 to open the communication port 40*a* to a degree corresponding to the degree of expansion of the bellows 37, whereby high pressure gas (back pressure Pk) flows from the high pressure chambers 42 into the suction chamber 22 via the holes 44, the internal space 33, the front bearing 10, the passage 46, the valve chamber 40, and the communication port 40*a*, which results in a decrease in the pressure Pk in the high pressure chambers 42, so that the difference Pk-Ps becomes smaller than the turning force F. As a result, the rotor element 28 and the control element 16 is rotated by the turning force F from the rotor 8 in the counterclockwise direction from the positions indicated by the solid lines in FIGS. 4 and 7, thereby increasing the opening angle of the second inlet ports 26. When the torque K as a function of the difference Pk-Ps becomes balanced with the frictional turning force F, the counterclockwise rotation of the rotary element 28 and the control element 16 ceases. If, on this occasion the ceased control element 16 and rotary element 28 assume the positions indicated by the two-dot chain lines in FIGS. 4 and 7, then the second inlet port 26 is widened through an angle A, as shown in FIG. 4.

Figure 2:
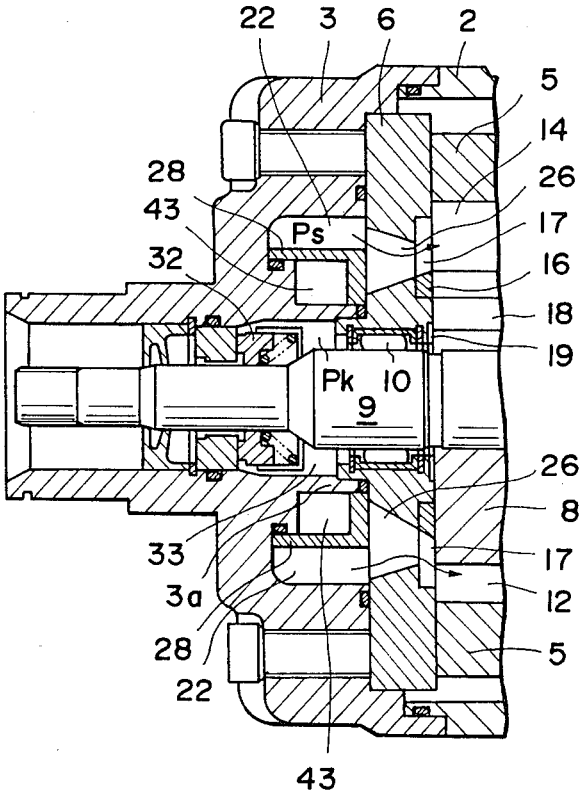
FIG. 2 is a longitudinal sectional view of essential part of the vane compressor of FIG. 1 at partial capacity operation.

In this case, the maximum amount of refrigerant enters the compression chamber 12 through the corresponding second inlet port 26 during the suction stroke, as indicated by the arrows in FIG. 2. Also, the timing at which the compression stroke begins is retarded by a time period corresponding to the opening angle A, and hence the amount of refrigerant that is compressed and delivered is reduced by an amount corresponding to the retardation time period.

Therefore, when the suction pressure Ps in the suction chamber 22 is lower than the aforementioned predetermined value, the angular positon of the rotary element 28 and the control element 16 (i.e. the angular position at which the turning force F which acts on the control element 16 and the value Pk-Ps which acts on the rotary element 28, are balanced), that is, the opening angle A of the second inlet ports 26 varies continuously with a change in the difference Pk-Ps. Hence, it is possible to control the discharge quantity of the compressor in a continuous manner.

Instead of introducing the back pressure Pk into the high pressure chamber 42, it is possible to introduce therein a discharge gas pressure (Pd) or a discharge oil pressure (Pd'), which is higher than the back pressure Pk, by providing the high pressure chamber 42 with a communication passage with a restriction therein leading from the discharge pressure chamber 24. In this case, both the discharge gas pressure (Pd) and the discharge oil pressure (Pd') are higher than the back pressure Pk, so that the value D of Pd-Ps or Pd'-Ps can be greater than Pk-Ps, and hence the rotary element 28 and the control element 16 will then rotate more promptly than they do in the case of the illustrated embodiment, in response to a change in the suction pressure Ps, thereby improving the responsiveness in control of the variable discharge capacity.

Furthermore, the control element 16 may be provided with biasing means such as a spring disposed to urge the control element 16 in the same direction as the rotational direction of the rotor 8.

Figure 9:
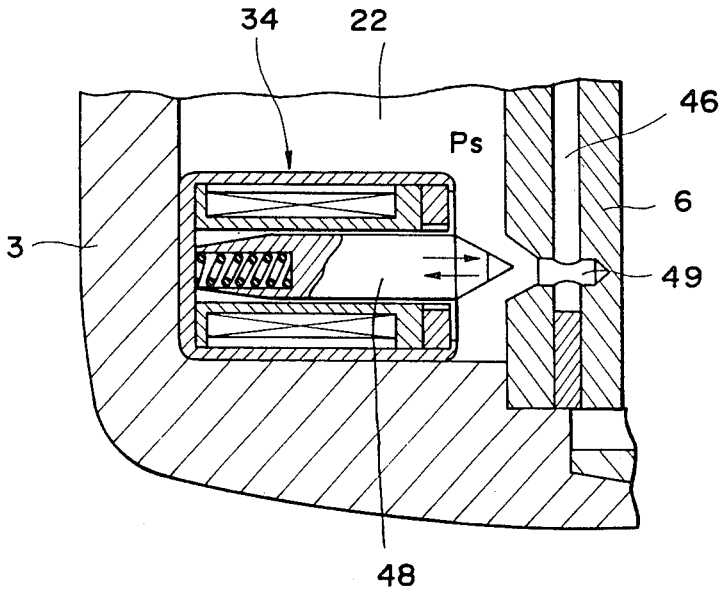
FIG. 9 is a sectional view showing another example of valve mechanism.

Also, instead of sensing the change of the suction pressure Ps by means of the bellows 37 in the valve mechanism 34, a change may be sensed in a signal representing a thermal load such as the discharge air temperature of the evaporator, passenger compartment temperature, atmospheric temperature, and solar radiation, and in response to such signal change an electromagnetic valve 48, as shown in FIG. 9, may be operated to interrupt or establish the communication between the valve chamber 49 and the suction chamber 22.

Referring next to FIGS. 10 through 14, a second embodiment of the invention will be described .

Figure 11:
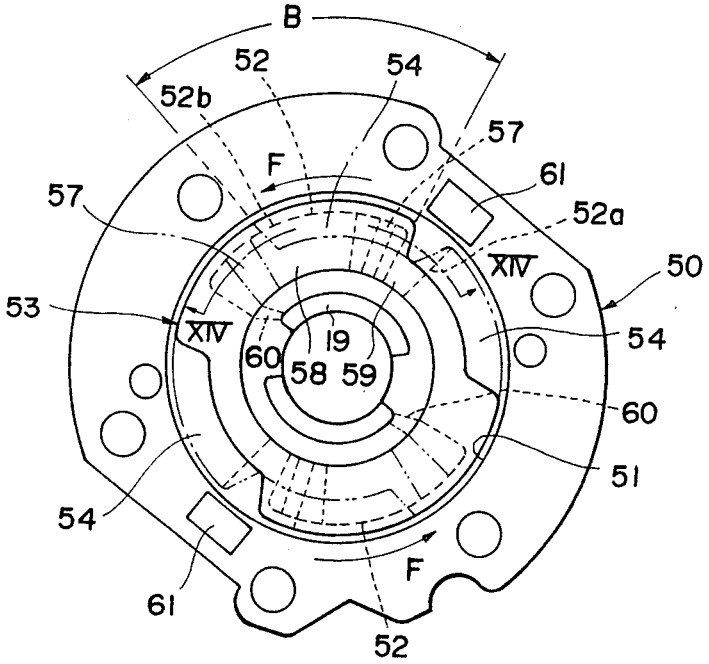
FIG. 11 is an end view of a front side block provided with a control element.
Figure 12:
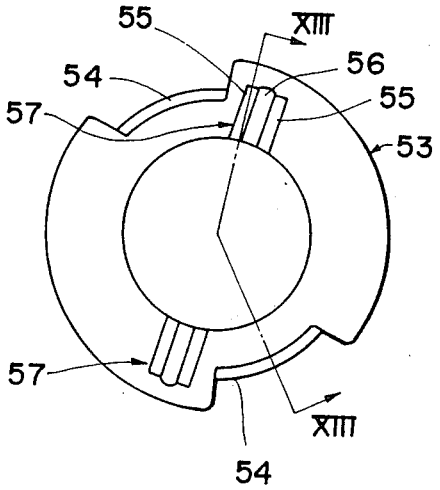
FIG. 12 is a front elevation of the control element.
Figure 13:
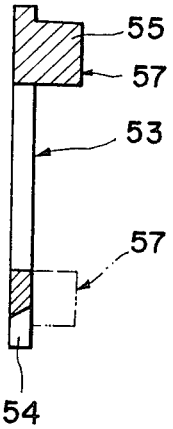
FIG. 13 is a sectional view taken along line XIII—XIII in FIG. 12.

As shown in FIG. 11, an annular groove 51 is formed in the rear side face of a front side block 50, and a pair of second inlet ports 52, 52 are formed in the bottom of the annular groove 51 at diametrically opposite locations. The second inlet ports 52, 52 each have an angled section, and are constructed by an opening **52*a* communicating with the suction chamber 22 and an opening 52*b* communicating with the compression chamber 12** on the suction stroke, which openings are circumferentially juxtaposed continuously to each other.

An annular control element 53 is fitted in the annular groove 51 for rotation to control the opening angle of the second inlet ports 52. The control element 53 has a pair of diametrically opposite cut-out portions 54, 54 along its periphery at upper and lower peripheral portions thereof, as viewed in FIG. 12. A pair of partition plates 55, 55 are provided on the control element 53, which axially radially extends from a side surface of the element 53 remote from the rotor 8 in the vicinity of each of the cut-out portions 54 of the control element 53, that is, at diametrically opposite locations. The partition plates 55 in each pair have a sealing plate 56 interposed therebetween and cooperate therewith to constitute a pressure-receiving protuberance 57, which is in hermetical and sliding contact with the inner peripheral surface of the opening **52*b* of the corresponding second inlet port 52, and divides the space in the second inlet port 52 into two chambers, i.e. a high pressure chamber 58, which has an arcuate section, and a low pressure chamber 59 communicating with the suction chamber 22. The high pressure chamber 58 communicates with the corresponding back pressure communication groove 19 via a hole 60 formed in the front side block 50, so that the back pressure Pk is introduced into the high pressure chamber 58**.

A pair of peripheral suction bores (refrigerant inlet ports) 61, 61 are provided in the front side block 50 and the cam ring 5 at locations radially outward of the groove 51 and axially in the cam ring 5 from an end face thereof, and then bend radially inwardly to open into the compression chamber 12 on the suction stroke, though not illustrated. Thus, the suction chamber 22 communicates with the compression chamber 12 on the suction stroke via the peripheral suction bores 61.

Figure 10:
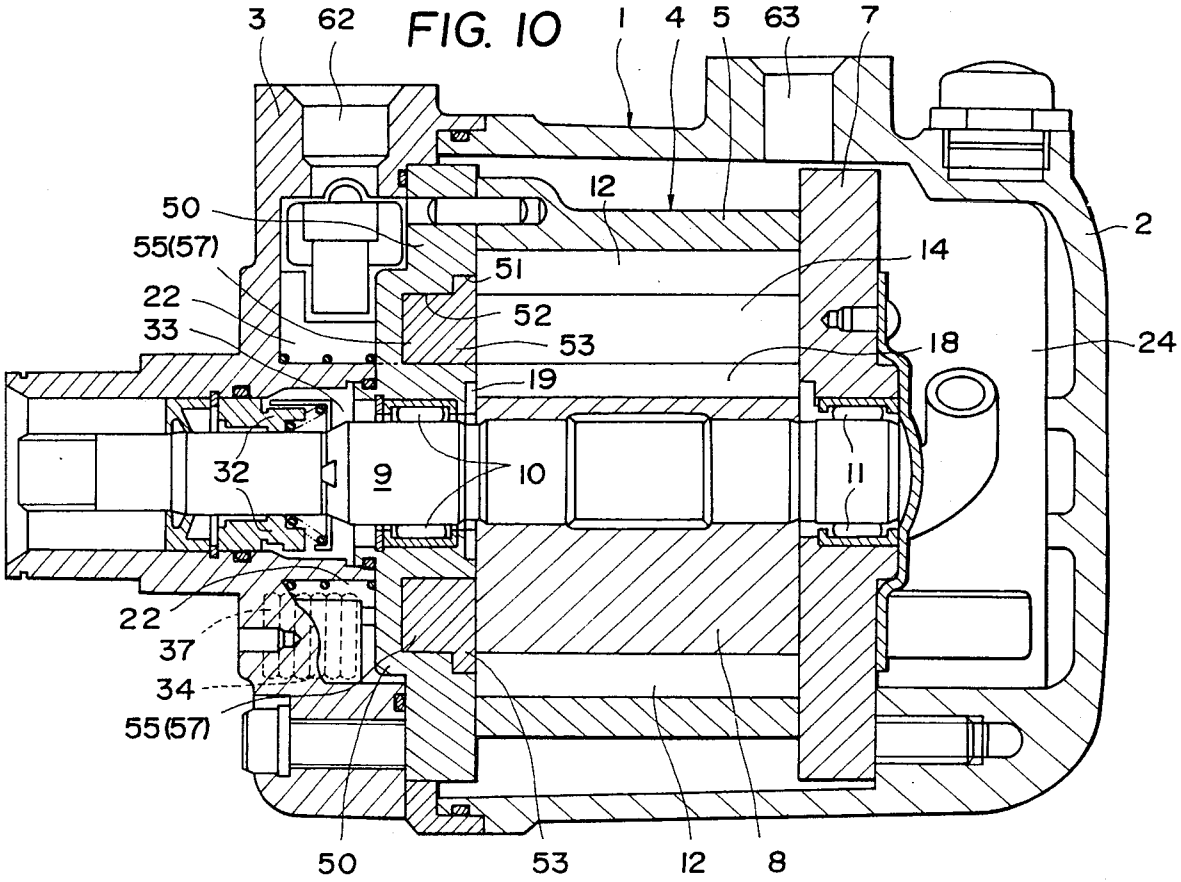
FIG. 10 is a longitudinal sectional view of a variable capacity vane compressor according to a second embodiment of the invention.

In FIG. 10, reference numeral 34 designates a valve mechanism of the same construction as the one in the first embodiment, and numerals 62 and 63 respectively designate a suction port and a discharge port for refrigerant gas. The other elements are identical in construction with corresponding ones in the first embodiment and are designated by like reference numerals, and their description is omitted.

Now, the operation of the second embodiment will be described.

When the compressor is operating, the control element 53 receives the turning force F from the rotor 8 to be urged thereby to rotate in the counterclockwise direction, as viewed in FIG. 11 (i.e. in the direction to open the second inlet port 52), similarly to the first embodiment.

Then, if the compressor is operating in a low rotational speed region where the suction pressure Ps in the suction chamber 22 is higher than a predetermined value, then, like the first embodiment, the communication port **40*a* of the valve mechanism 34 is blocked. As a result, the back pressure Pk in the high pressure chamber 58 of the compressor is held high such that the difference between the pressure Pk and the suction pressure Ps, i.e. Pk-Ps, is greater than the turning force F, whereby the control element 53 is rotated against the turning force F, in such a direction that the volume of the high pressure chamber 58, to which the back pressure Pk is supplied, increases (i.e. clockwise as viewed in FIG. 11 and rightwardly as viewed in FIG. 14), until the control element 53 assumes the position indicated by the solid line in FIGS. 11 and 14 to thereby close the second inlet ports 52 of the front side block 50. In this case, during the suction stroke all the refrigerant that is sucked into the compression chamber 12 on the suction stroke from the corresponding suction chamber 22 via the peripheral suction bore 61** is compressed during the following compression stroke and then discharged. Thus, the compressor is operated at its maximum capacity.

When the compressor is operating in a high speed region where the suction pressure Ps in the suction chamber 22 is smaller than the aforementioned predetermined value, the bellows 37 of the valve mechanism 34 expands to urgingly displace the ball valve 36 via the push rod 38 to open the communication port **40*a* of the valve chamber 40 to a degree corresponding to the degree of expansion of the bellows 37, whereby the high pressure gas (back pressure Pk) flows from the high pressure chamber 58 into the suction chamber 22 at a flow rate corresponding to the opening of the communication port 40*a* via the holes 60, the back pressure communication grooves 19, the bearing 10 on the front side, the passage 46, the valve chamber 40, and the communication port 40***a*, which results in a decrease in the back pressure Pk in the high pressure chamber 58, so that the difference Pk-Ps is smaller than the turning force F. As a result, the control element 53 is urged by the turning force F from the rotor 8 to rotate counterclockwise from the position indicated by the solid lines toward that indicated by the two-dot lines shown in FIGS. 11 and 14, thereby increasing the opening angle of the second inlet ports 52. Similarly to the first embodiment, when the rotational torque K applied to the control element 53 as a function of the difference Pk-Ps becomes balanced with the turning force F, the counterclockwise rotation of the control element 53 ceases. If on this occasion the ceased control element 53 assumes the position indicated by the two-dot chain lines in FIG. 11, then the second inlet port 52 of the opening 52*b* is opened through an angle B.

Figure 14:
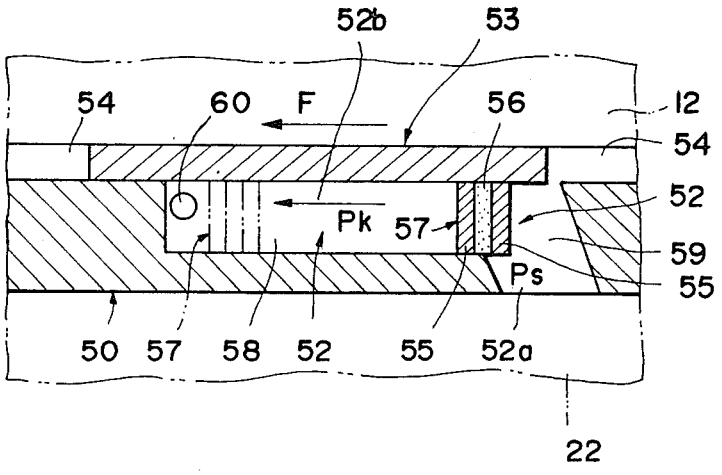
FIG. 14 is a sectional view taken along line XIV—XIV in FIG. 11.

Also, the timing at which the compression stroke begins is retarded by a time period corresponding to the opening angle B, as indicated by the two-dotted arrows in FIG. 14, and hence the amount of refrigerant that is compressed is reduced by an amount corresponding to the retardation time period, resulting in a reduced delivery quantity.

Therefore, similarly to the first embodiment, the opening angle B of the opening 52*b* of the second inlet port 52 varies continuously in response to a change in the pressure difference Pk-Ps. Hence, it is possible to control the discharge quantity of the compressor in a continuous manner.

Instead of introducing the back pressure Pk into the high pressure chamber 58, it is possible to introduce therein a discharge gas pressure (Pd) or a discharge oil pressure (Pd'), which is higher than the back pressure Pk, by providing the high pressure chamber 58 with a communication passage with a restriction therein leading from the discharge pressure chamber 24. In this case, both the discharge gas pressure (Pd) and the discharge oil pressure (Pd') are higher than the back pressure Pk, so that the value of Pd-Ps or Pd'-Ps can be greater than Pk-Ps, and hence the control element 53 will then rotate more promptly than in the case of the illustrated embodiment, in response to a change in the suction pressure Ps, thereby improving the responsiveness in control of the variable discharge capacity.

Furthermore, the control element 53 may be provided with biasing means such as a spring disposed to urge the control element 53 in the same direction as the rotational direction of the rotor 8.

Also, instead of sensing the change of the suction pressure Ps by means of the bellows 37 in the valve mechanism 34, a change may be sensed in a signal representing a thermal load such as the discharge air temperature of the evaporator, passenger compartment temperature, atmospheric temperature, and solar radiation, and in response to such signal change an electromagnetic valve 48, as shown in FIG. 9, may be operated to interrupt or establish the communication between the valve chamber 49 and the suction chamber 22.

According to the second embodiment, the control element for opening and closing the second inlet ports comprises a single part, and thus the construction is simple and has high reliability in control of the capacity of the compressor.

What is claimed is:

1. In a variable capacity vane compressor including a housing defining a suction chamber, a cylinder formed of a cam ring and a pair of side blocks closing opposite ends of said cam ring, said cylinder having at least one first inlet port formed therein, a rotor rotatably received within said cylinder, and a plurality of vanes radially slidably fitted in respective slits formed in said rotor, wherein compression chambers are defined between said cylinder, said rotor and adjacent ones of said vanes, and said chambers vary in volume with rotation of said rotor for effecting suction of a compression medium from said suction chamber into said compression chambers through said at least one first inlet port, compression and discharge of said compression medium, the improvement comprising:

at least one second inlet port, adjacent a corresponding one of said first inlet port at a side downstream thereof in an advancing direction of said vanes, said at least one second inlet port being formed in said one of said side blocks and communicating said suction chamber with at least one of said compression chambers when on a suction stroke;

opening control means for varying an opening angle of said at least one second inlet port, said opening control means having a pressure receiving portion defining a first pressure chamber communicating with a high pressure side to be supplied with discharge pressure therefrom and a second pressure chamber communicating with said suction chamber to be supplied with suction pressure therefrom, said pressure receiving portion being angularly displaceable in response to a difference between a relatively high pressure in said first pressure chamber and a relatively low pressure in said second pressure chamber, for causing said opening control means to vary the opening angle of said at least one second inlet port; and pressure control means responsive to at least one parameter representative of a thermal load on said compressor for varying at least one of said high pressure in said first pressure chamber and said lower pressure in said second pressure chamber, wherein a change in the opening angle of said at least one second inlet port causes a change in the timing of initiation to the compression of the compression medium;

said pressure control means comprising a valve mechanism adapted to detect said suction pressure of said compression medium in said suction chamber as said at least one parameter representative of the thermal load on said compressor, to be closed to disconnect said first pressure chamber and said suction chamber from each other when the detected suction pressure is higher than a predetermined value, and to be opened to a degree corresponding to the detected suction pressure to allow escape of said relatively high pressure in said first pressure chamber to said suction chamber to thereby decrease said difference between said relatively high pressure in said first pressure chamber and relatively low pressure in said second pressure chamber when the detected suction pressure is lower than said predetermined value.

2. A variable capacity vane compressor as claimed in claim 1, wherein said opening control means comprises a control element disposed in close proximity to an end face of said rotor facing said one of said side blocks for rotation about an axis common with an axis of rotation of said rotor in a manner being acted upon by a turning force produced by rotation of said rotor, said control element being so disposed that circumferential position thereof determines the opening angle of said at least one second inlet port, and a rotary element having said pressure receiving portion and engaging with said control element for rotation together therewith, said rotary element being responsive to a change in said difference between said high and low pressures for imparting a rotating force to said control element.

3. A variable capacity vane compressor as claimed in claim 1, wherein said opening control means comprises a control element disposed in close proximity to an end face of said rotor facing said one of said side blocks for rotation about an axis common with an axis of rotation of said rotor in a manner being acted upon by a turning force produced by rotation of said rotor, said control element being so disposed that circumferential position thereof determines the opening angle of said at least one second inlet port, said pressure receiving portion being provided integerally on said control element in a manner such that angular displacement of said pressure receiving portion responsive to said difference between said high and low pressures causes rotation of said control element.

4. A variable capacity vane compressor as claimed in claim 1, wherein said first pressure chamber is supplied with a back pressure acting upon a base end of each of said vanes.

5. A variable capacity vane compressor as claimed in claim 1, wherein said first pressure chamber is supplied with a discharge pressure of said compression medium discharged from said compression chambers.

6. A variable capacity vane compressor as claimed in claim 1, wherein said first pressure chamber is supplied with a discharge pressure of lubricating oil contained in said compression medium and discharged from said compression chambers together with said compression medium.

7. A variable capacity vane compressor as claimed in claim 1, wherein said value mechanism comprises a bellows arranged in said suction chamber for contraction and expansion in response to said suction pressure within said suction chamber, and a valve body adapted to be closed to disconnect said first and second pressure chambers from each other when said bellows contracts, and to be opened to a degree corresponding to said suction pressure to allow communication between said first and second pressure chambers when said bellows expands.

8. In a variable capacity vane compressor including a housing defining a suction chamber, a cylinder arranged within said housing and formed of a cam ring and a pair of side blocks closing opposite ends of said cam ring, one of said side blocks having at least one first inlet port formed therein, a rotor rotatably received within said cylinder, and a plurality of vanes radially slidably fitted in respective slits formed in said rotor, wherein compression chambers are defined between said cylinder, said rotor and adjacent ones of said vanes, and said chambers vary in volume with rotation of said rotor for effecting suction of a compression medium from said suction chamber into said compression chambers through said at least one first inlet port, compression and discharge of said compression medium, the improvement comprising:

at least one second inlet port, adjacent a corresponding one of said first inlet port, formed in said one of said side blocks and communicating said suction chamber with at least one of said compression chambers when on a suction stroke;

opening control means for varying an opening angle of said at least one second inlet port, said opening control means having a pressure receiving portion defining a first pressure chamber supplied with a high pressure and a second pressure chamber supplied with a low pressure, said pressure receiving portion being angularly displaceable in response to a difference between said high pressure in said first pressure chamber and said low pressure in said second pressure chamber, for causing said opening control means to vary the opening angle of said at least one second inlet port; and pressure control means responsive to at least one parameter representative of a thermal load on said compressor for varying at least one of said high pressure in said first pressure chamber and said low pressure in said second pressure chamber, wherein a change in the opening angle of said at least one second inlet port causes a change in the timing of initiation of the compression of the compression medium;

wherein said first pressure chamber is arranged to communicate with a back pressure acting upon a base end of each of said vanes.

9. In a variable capacity vane compressor including a housing defining a suction chamber, a cylinder arranged within said housing and formed of a cam ring and a pair of side blocks closing opposite ends of said cam ring, said cylinder having at least one first inlet port formed therein, a rotor rotatably received within said cylinder, and a plurality of vanes radially slidably fitted in respective slits formed in said rotor, wherein compression chambers are defined between said cylinder, said rotor and adjacent ones of said vanes, and said chambers vary in volume with rotation of said rotor for effecting suction of a compression medium from said suction chamber into said compression chambers through said at least one first inlet port, compression and discharge of said compression medium, the improvement comprising:

at least one second inlet port, adjacent a corresponding one of said first inlet port, formed in said one of said blocks and communicating said suction chamber with at least one of said compression chambers when on a suction stroke;

opening control means for varying an opening angle of said at least one second inlet port, said opening control means having a pressure receiving portion defining a first pressure chamber communicating with a high pressure side and a second pressure chamber communicating with a low pressure side, said pressure receiving portion being angularly displaceable in response to a difference between a relatively high pressure in said first pressure chamber and a relatively low pressure in said second pressure chamber, for causing said opening control means to vary the opening angle of said at least one second inlet port;

said first pressure chamber being supplied with a back pressure acting upon a base end of each of said vanes; and pressure control means responsive to at least one parameter representative of a thermal load on said compressor for varying at least one of said high pressure in said first pressure chamber and said low pressure in said second pressure chamber, wherein a change in the opening angle of said at least one second inlet port causes a change in the timing of initiation of the compression of the compression medium.

10. In a variable capacity vane compressor including a housing defining a suction chamber, a cylinder arranged within said housing and formed of a cam ring and a pair of side blocks closing opposite ends of said cam ring, said cylinder having at least one first inlet port formed therein, a rotor rotatably received within said cylinder, and a plurality of vanes radially slidably fitted in respective slits formed in said rotor, wherein compression chambers are defined between said cylinder, said rotor and adjacent ones of said vanes, and said chambers vary in volume with rotation of said rotor for effecting suction of a compression medium from said suction chamber into said compression chambers through said at least one first inlet port, compression and discharge of said compression medium, the improvement comprising:

at least one second inlet port, adjacent a corresponding one of said first inlet port at a side downstream thereof in an advancing direction of said vanes, said at least one second inlet port being formed in said one of said side blocks in a fashion being interposed between said suction chamber and at least one of said compression chambers and opening directly into said suction chamber and said at least one of said compression chambers when on a suction stroke;

opening control means for varying an opening angle of said at least one second inlet port, said opening control means having a pressure receiving portion defining a first pressure chamber communicating with said discharge pressure chamber to be supplied with discharge pressure therefrom and a second pressure chamber communicating with said suction chamber to be supplied with suction pressure therefrom, said pressure pressure receiving portion being angularly displaceable in response to a difference between a relatively high pressure in said first pressure chamber and a relatively low pressure in said second pressure chamber, for causing said opening control means to vary the opening angle of said at least one second inlet port; and pressure control means responsive to at least one parameter representative of a thermal load on said compressor for varying at least one of said high pressure in said first pressure chamber and said lower pressure in said second pressure chamber, wherein a change in the opening angle of said at least one second inlet port causes a change in the timing of initiation of the compression of the compression medium;

said pressure control means comprising a valve mechanism including an electromagnetic valve adapted to be closed and opened in response to said at least one parameter representative of the thermal load on said compressor for selecting disconnecting said first and second pressure chambers from each other and connecting between said first and second pressure chambers to a degree corresponding to the value of said at least one parameter to thereby decrease said difference between said relatively high and low pressures.

* * * * *

UNITED STATES PATENT AND TRADEMARK OFFICE

CERTIFICATE OF CORRECTION

PATENT NO. : 4,778,352

DATED : Oct. 18, 1988

INVENTOR(S) : NAKAJIMA

It is certified that error appears in the above-identified patent and that said Letters Patent is hereby corrected as shown below:

Title page, right-hand column, under "Foreign Patent Documents" insert -- Japanese 61-232397 filed 10/16/87 and Japanese 55-2000 filed 1/8/80 --

Signed and Sealed this

Twenty-sixth Day of September, 1989

*Attest:*

DONALD J. QUIGG

*Attesting Officer*

*Commissioner of Patents and Trademarks*